US006732437B2

(12) United States Patent
Eisen et al.

(10) Patent No.: US 6,732,437 B2
(45) Date of Patent: May 11, 2004

(54) SOFT LEAD SHARPENER WITH PIVOTABLE PROFILE KNIFE

(75) Inventors: Johann Eisen, Moehrendorf (DE); Reiner Eisen, Baiersdorf (DE)

(73) Assignee: Eisen GmbH, Baiersdorf (DE)

( * ) Notice: Subject to any disclaimer, the term of this patent is extended or adjusted under 35 U.S.C. 154(b) by 36 days.

(21) Appl. No.: 10/160,136

(22) Filed: May 31, 2002

(65) Prior Publication Data

US 2003/0163925 A1 Sep. 4, 2003

(30) Foreign Application Priority Data

Mar. 4, 2002 (DE) ..... 102 09 192

(51) Int. Cl.[7] ..... B43L 23/08
(52) U.S. Cl. ..... 30/461; 30/457
(58) Field of Search ..... 30/452, 453, 454, 30/455, 456, 457, 459, 461; 144/28.11

(56) References Cited

U.S. PATENT DOCUMENTS 4,248,283 A * 2/1981 Kaye ..... 30/454
4,281,698 A * 8/1981 Mobius ..... 30/454
5,167,071 A * 12/1992 Eisen ..... 30/452
5,894,669 A * 4/1999 Luttgens ..... 30/452
5,987,759 A * 11/1999 Nita ..... 30/454
6,301,791 B1 * 10/2001 Luttgens ..... 30/454
6,397,479 B1 * 6/2002 Luttgens ..... 30/454

FOREIGN PATENT DOCUMENTS

DE 37 37 863 8/1988

* cited by examiner

*Primary Examiner*—Hwei-Siu Payer
(74) *Attorney, Agent, or Firm*—Jordan and Hamburg LLP

(57) ABSTRACT

A sharpener for pencils with a soft lead with a sharpener housing has a conical sharpener channel, a sharpening knife which is fastened at the fastener housing and which is set tangentially to the sharpener channel. A shape-cutting knife, which can be swiveled into the sharpener channel, is provided with a manually actuated lever and with an arc-shaped, curved cutting edge for the selective shaping of the front end section of the lead. The sharpener is constructed as a double sharpener with individual sharpeners for pencils of different diameters placed opposite to one another in a common housing and the shape-cutting knives can be swiveled alternatively upward against the lead in the respective individual sharpener about a common axis, which is disposed at the common front end of the sharpener channels which are open in the upward and downward directions in this region.

28 Claims, 2 Drawing Sheets

SOFT LEAD SHARPENER WITH PIVOTABLE PROFILE KNIFE

BACKGROUND OF THE INVENTION

Figure 1:
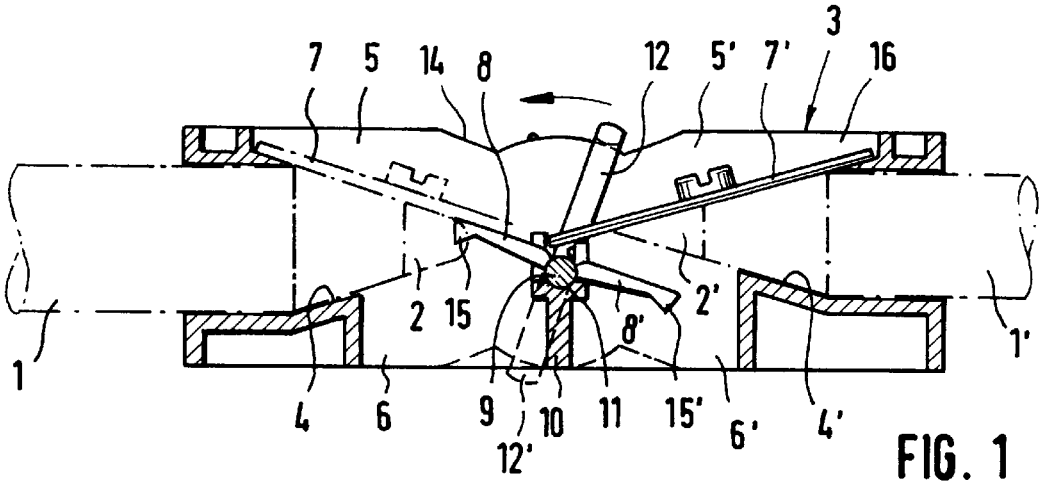

The invention relates to a sharpener for pencils with a soft lead with a sharpener housing, which has a conical sharpener channel, with a sharpening knife, which is fastened at the sharpener housing and is set tangentially to the sharpener channel, and with a shape-cutting knife, which can be swiveled into the sharpener channel, is provided with a manually actuated lever and is provided with an arc-shaped, curved cutting edge for the selective profiling of the front end section of the lead.

In the case of such a sharpener, which is described in the German patent 37 37 863 C1, the shape-cutting knife is mounted at a plug, which can be pressed from below into a recess of the sharpener housing. This construction has the disadvantage that, on the one hand, the downward opening, out of which normally the sharpening waste falls, is largely closed off by this plug and, on the other, that the sharpener housing must have a complex surface formation with lateral bulges, in order to form a bearing part for the pivotable carrier of the shape-cutting knife.

SUMMARY OF THE INVENTION

It is therefore an object of the invention to configure a sharpener of the type named above, so that a particularly simple construction and a simple, clear surface formation of the sharpener housing is possible in conjunction with the possibility of sharpening the points of pencils of different diameters.

In the case of a sharpener of the type named above, this objective is accomplished pursuant to the invention owing to the fact that it is constructed as a double sharpener with individual sharpeners for pencils of different diameters placed opposite to one another in a common housing and that the shape-cutting knives can be swiveled alternatively upward against the lead in the respective individual sharpener about a common axis, which is disposed at the common front end of the sharpener channels, which are open in the upward and downward directions in this region.

The inventive construction makes a very simple support possible with the help of a bearing shaft, which is integrally molded to the shape-cutting knife that preferably consists of plastic. Due to the inventive double sharpener construction, for which alternately one of the shape cutting knives makes contact from below with the respective sharpener knife, the two operating positions are also specified at the same time. In the one swiveling position, the shape-cutting knife of the one individual sharpener is in the operating position and the other is not. The reverse relationships are obtained by swiveling about the bearing axis. When the shape-cutting knife is swung out, the tip of the lead will be point-shaped and, when the shape-cutting knife is swung in, that is, in the quasi contacting position of the shape-cutting knife at the sharpener knife, the tip of the lead is shaped, that is, profiled with rounded end section.

In a development of the invention, a shape-cutting knife, consisting of plastic, can be offset by 180° at a rotating shaft mounted laterally at the housing.

In a further development of the invention, the rotating shaft can be integrally molded with pivoted levers protruding up or down. These pivoted levers may preferably be constructed L-shaped with transverse legs, supported as stops, limiting the extent of swivel, on the upper edges or lower edges of the longitudinal walls of the housing.

This construction, with stops, limiting the extent of swivel, optionally enables the shape-cutting knife to be constructed in such a manner that it does not lie against the sharpener knives in the operating position and, instead, lies next to these precisely in the same cutting plane. This results in an optimal arrangement of the cutting edges of the shape-cutting knives with respect to the tip of the lead.

Instead of pivoted levers, adjusting knobs can also be provided on the rotating shaft to actuate the pivoting. This development of the invention can be realized particularly easily if the rotating shaft passes through vertical slots of the longitudinal walls of the housing, so that the rotating shaft with the integrally molded shape-cutting knives can be inserted very easily from above into the housing. In this connection, provisions are advantageously of course made so that, by locking stops somewhat overlapping the rotating shaft in the inserted position, an excessively easy unlocking in the upward direction is prevented. In the same way, it is advisably possible to provide locking catches, in order to lock the rotating shaft with the two shape-cutting knives in one of the two end positions set.

In a further development of the invention, the shape-cutting knives can be provided with bent cutting cross members, which correspond to the desired contour of the profiled lead and are essentially triangular in cross section, so that a true chip-removing cutting takes place and not merely a scraping of the tip of the soft lead, as a result of which an expensive cleaning with the help of cleaning rods or the like can be avoided after each profiling process.

Finally, it is also within the scope of the invention that the rotating shaft is seated with a bearing troughing on a lower, transverse partition of the sharpener channels.

Further advantages, distinguishing features and details of the invention arise out of the following description of an example as well as from the accompanying drawings.

IN THE DRAWINGS

Figure 2:
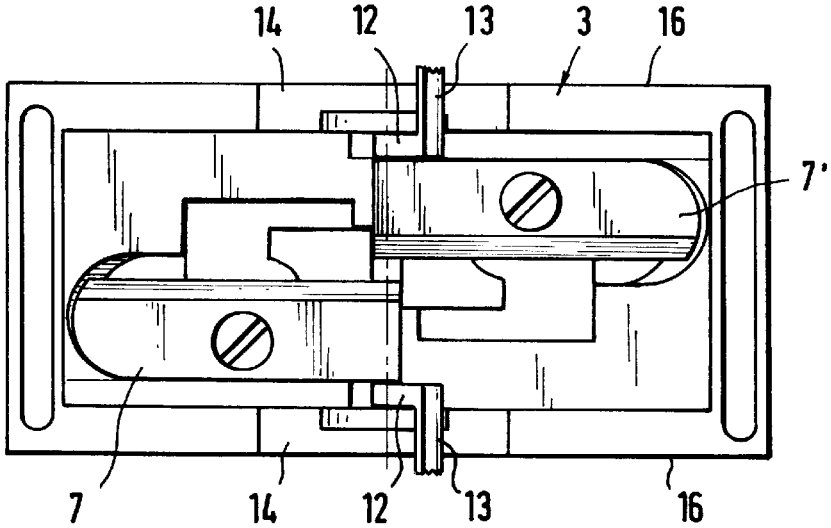
Figure 3:
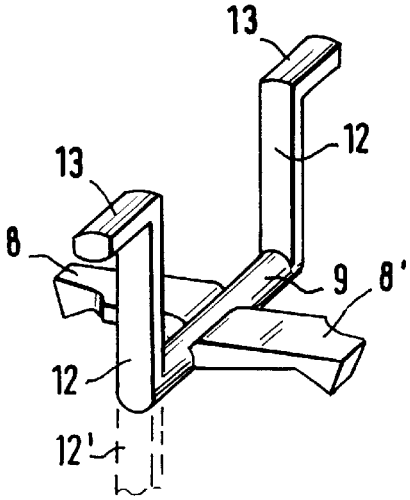
Figure 4:
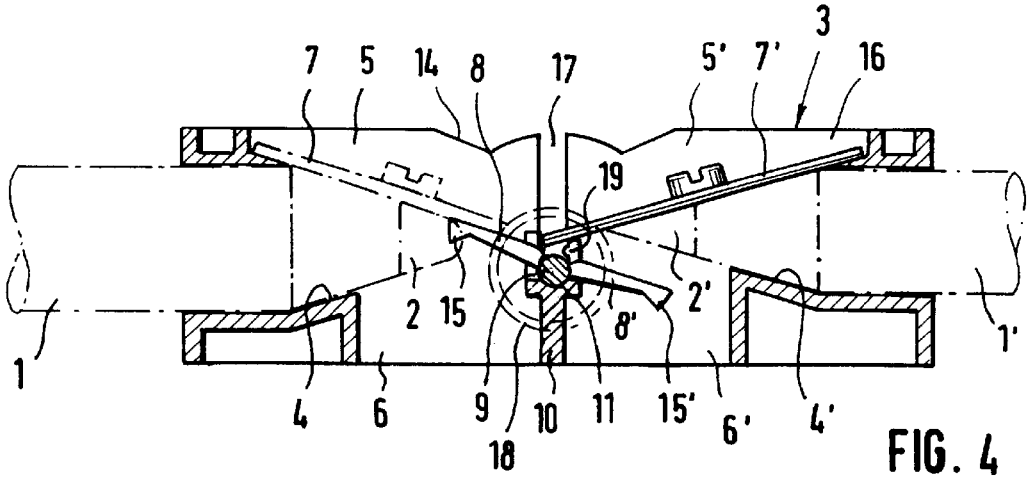
Figure 5:
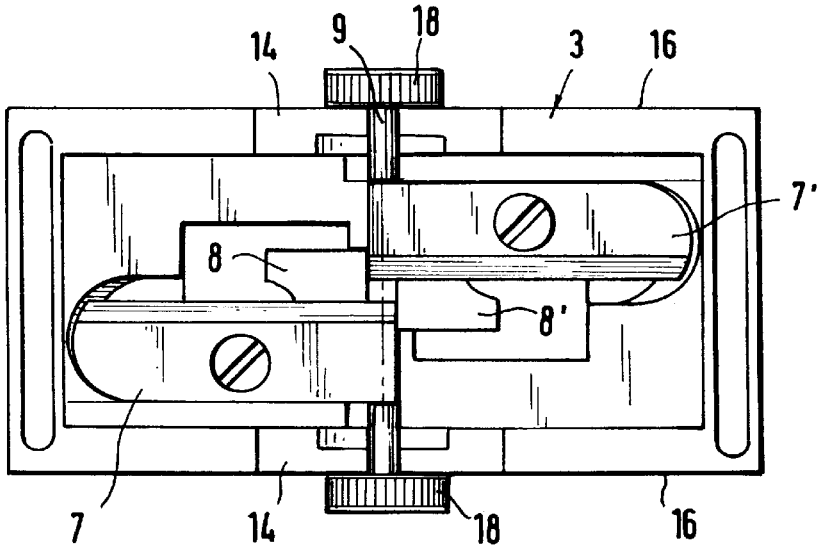
Figure 6:
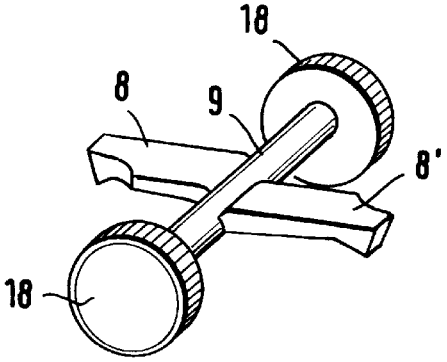

FIG. 1 shows a longitudinal section through a first embodiment of an inventive double soft lead sharpener for sharpening two pencils of different diameters, FIG. 2 shows a plan you view of the double sharpener of FIG. 1, FIG. 3 shows a prospective view of the two shape-cutting knives with the bearing shaft carrying them and of the actuating levers, and FIGS. 4–6 show the sections and views, corresponding to FIGS. 1 to 3, of a second embodiment of an inventive double sharpener.

The double sharpener for pencils 1 or 1' of different diameters, shown in FIGS. 1 to 3, with, in each case, a soft lead 2 or 2', has a housing 3, preferably of plastic, in which two conical sharpener channels 4, 4' are disposed with the tips facing one another and have upward and downward directed openings 5 and 6 or 5' and 6' at the front end, where the sharpener channels 4 and 4' change over into one another. In each of the sharpener housing sections, that is, assigned to each sharpener channel 4, 4', a sharpener knife 7, 7' is fastened tangentially to the respective sharpener channel 4, 4'.

DESCRIPTION OF THE PREFERRED EMBODIMENTS

For alternatively profiling the front end section of the lead 2, 2' of a pencil 1, 1', preferably a shape-cutting knife 8, 8', consisting of a plastic, is provided, these two shape-cutting knives 8, 8' being fastened and particularly integrally molded at a common rotating shaft 9, which is mounted laterally at the sharpener housing 3 and, in addition, supported at a lower, transverse partition 10 of the sharpener channels 4, 4' with a bearing troughing 11. The rotating shaft 9 is provided at both ends with upwardly protruding L-shaped pivoted levers 12, the transverse legs 13 of which, as stops limiting the extent of swivel, are supported on the upper edges 14 of the longitudinal walls 16 of the housing 3. In the end positions, formed by this support, in each case one of the shape-cutting knives 8, 8' at the associated cutting knives 7, 7' is located so that this applies for the shape-cutting knife 8 in the Figures—a profiling of the tip of the soft lead 2, 2' takes place in the corresponding sharpener channel 4, 4'. When sharpening with the other half of the soft lead sharpener, a fine point of the lead is formed without profiling, as shown in FIG. 1 at the right. By shifting the pivoted levers 12, the shape-cutting knife 8 is moved out of the operating position and the shape-cutting knives 8' is brought into the operating position.

Instead of the upwardly protruding pivoted levers 12, it is also possible to provide downwardly protruding pivoted levers 12', which are supported with their transverse legs 13' as stops, limiting the extent of swivel, on the lower edges 14' of the longitudinal walls 16 of the housing.

The embodiment of FIGS. 4 to 6 differs from that of FIGS. 1 to 3 only by virtue of the fact that, instead of the pivoted lever 12, adjusting knobs 18 are mounted on the ends of the rotating shaft 9. In order to be able to install the component, consisting of the rotating shaft 9, the shape-cutting knives 8, 8' and the adjusting knobs 18, particularly easily, it is possible to provide the longitudinal walls 16 of the housing with vertical slots 17, through which the whole component can be inserted from above up to the end position at the end of the vertical slots 17, which can be seen in FIG. 4. Preferably, bosses 19, which overlap the rotating shaft 9, are provided in this region. Under these bosses 19, the rotating shaft 9 latches under pressure, so that an appropriately large force would be required for loosening the component, which cannot simply be lifted out upward.

As already described at the beginning, the construction can also be such that, in the stop position of the transverse legs 13 on the side edges 14 of the longitudinal walls 16 of the housing, the respective shape-cutting knives 8, 8' do not lie against the cutting knife 7, 7' and, instead, can be moved laterally past these into a position, in which the cutting edge of the arc-shaped cutting cross members 15, 15', which are triangular in cross section and are integrally molded at the shape-cutting knives 8, 8', lies precisely in the central plane of the respective lead 2, 2'. Accurate profiling can therefore take place.

What is claimed is:

1. A sharpener for pencils with a soft lead, comprising a sharpener housing, which has a conical sharpener channel, with a sharpening knife, which is fastened at the sharpener housing and is set tangentially to the sharpener channel, and with a shape-cutting knife, which can be swivelled into the sharpener channel, is provided with a manually actuated lever, and is provided with an arc-shaped, curved cutting edge for the selective shaping of a front end section of the lead, wherein the sharpener is constructed as a double sharpener with individual sharpeners for pencils of different diameters placed opposite to one another in a common housing (3) and that the shape-cutting knives (8, 8') can be swivelled alternatively upward against the lead (2, 2') in the respective individual sharpener about a common axis, which is disposed at a common front end of the sharpener channels (4,4'), which are open in the upward and downward directions in this region.

2. The double sharpener of claim 1, wherein the shape-cutting knives (8, 8'), consisting of plastic, are integrally molded offset by 180° at a rotating shaft (9) mounted laterally at the housing.

3. The double sharpener of claim 2, wherein the rotating shaft (9) is provided with upright or downwardly protruding pivoted levers (12, 12').

4. The double sharpener of claim 2, wherein the rotating shaft (9) is seated on a lowered partition (10) of the sharpener channels (4, 4') with a bearing troughing (11).

5. The double sharpener of claim 3, wherein the pivoted levers (12) are constructed L-shaped with transverse legs (13, 13'), which are supported as stops, limiting the swiveling, on the upper edges (14) or the lower edges (14') of the longitudinal walls (16) of the housing.

6. The double sharpener of claim 2, wherein the rotating shaft (9) passed through vertical slots (17) of the longitudinal walls (16) of the housing and is provided with adjusting knobs (18).

7. The double sharpener of claim 6, wherein the rotating shaft (9) is held locked in position at the lower end of the slots (17) by bosses (19) provided extending into the slots (17).

8. The double sharpener of claim 2, wherein there are latching devices for releasably locking the rotating shaft (9) with the shape-cutting knives (8, 8') in one of the two end positions.

9. The double sharpener of claim 1, wherein the shape-cutting knives (8, 8') are provided with bent, cutting cross members (15), which are essentially triangular in cross section and correspond to the desired contour of the profiled lead (2, 2').

10. A sharpener for sharpening a pencil and lead thereof, comprising:

a sharpener housing defining a conical sharpener channel;

a sharpening knife disposed in said sharpener housing and tangentially entering said conical sharpener channel; and a shape-cutting knife mounted on a rotating shaft in said sharpener housing to permit swiveling into a conical end tip of the conical sharpener channel, the shaft extending transverse to an axis of said conical sharpener channel;

said rotating shaft having a manually operable member to allow movement of said shape-cutting knife into and out of engagement with said lead of said pencil when inserted into said conical sharpener channel; and said shape-cutting knife having an arc-shaped cutting edge for shaping of a front end section of the lead.

11. The sharpener of claim 10, wherein the conical sharpener channel defines openings extending longitudinally with respect to said sharpener conical channel and at opposing sides of said sharpener housing.

12. The sharpener of claim 11, wherein the manually operable member is a lever extending from said rotating shaft.

13. The sharpener of claim 12, wherein the rotating shaft is seated in a bearing trough defined by said sharpener housing.

14. The sharpener of claim 13, wherein said lever is L-shaped with a transverse leg extending parallel with respect to a direction of the axis of said rotating shaft, said sharpener housing having side walls with edges, and said transverse leg engaging one of said edges to limit movement of said shape-cutting knife to a cutting position.

15. The sharpener of claim 11, wherein the manually operable member is a knob extending from an end of said rotating shaft.

16. The sharpener of claim 15, wherein the rotating shaft is seated in a bearing trough defined by said sharpener housing.

17. The sharpener of claim 16, wherein the rotating shaft passes through vertical slots of the walls of the housing.

18. The sharpener of claim 17, wherein the rotating shaft is held locked in position at the lower end of the slots by bosses provided extending into the slots.

19. A double sharpener for sharpening pencils and leads thereof, comprising:

a sharpener housing defining coaxially extending first and second conical sharpener channels having conical tip portions opposing one another;

first and second sharpening knives disposed in said sharpener housing and respectively tangentially entering said first and second conical sharpener channels; and first and second shape-cutting knives mounted on a common rotating shaft in said sharpener housing to permit swiveling into respective ones of said conical tip portions of the first and second conical sharpener channels, the shaft extending transverse to an axis of said conical sharpener channels and between said conical tip portions;

said rotating shaft having a manually operable member to allow movement of said first and second shape-cutting knives into and out of engagement with said leads of said pencils when inserted into respective ones of said first and second conical sharpener channels; and said shape-cutting knives each having an arc-shaped cutting edge for shaping of a front end section of the lead.

20. The double sharpener of claim 19, wherein the shape-cutting knives are offset by 180° on said rotating shaft.

21. The sharpener of claim 20, wherein the first and second conical sharpener channels define openings extending longitudinally with respect to said first and second conical sharpener channels and at opposing sides of said sharpener housing.

22. The sharpener of claim 21, wherein the manually operable member is a lever extending from said rotating shaft.

23. The sharpener of claim 22, wherein the rotating shaft is seated in a bearing trough defined by said sharpener housing.

24. The sharpener of claim 23, wherein said lever is L-shaped with a transverse leg extending parallel with respect to a direction of the axis of said rotating shaft, said sharpener housing having side walls with edges, and said transverse leg engaging one of said edges to limit movement of at lest one of said first and second shape-cutting knives to a cutting position.

25. The sharpener of claim 21, wherein the manually operable member is a knob extending from an end of said rotating shaft.

26. The sharpener of claim 25, wherein the rotating shaft is seated in a bearing trough defined by said sharpener housing.

27. The sharpener of claim 26, wherein the rotating shaft passes through vertical slots of the walls of the housing.

28. The sharpener of claim 27, wherein the rotating shaft is held locked in position at the lower end of the slots by bosses provided extending into the slots.

* * * * *